United States Patent [19]

Maertens

[11] 4,443,203

[45] Apr. 17, 1984

[54] FLOATING MARKER

[76] Inventor: Gregory E. Maertens, 8356-79th St., Cottage Grove, Minn. 55016

[21] Appl. No.: 344,392

[22] Filed: Feb. 1, 1982

[51] Int. Cl.[3] ..... B63B 21/52

[52] U.S. Cl. ..... 441/22; 441/25; 441/26; 441/28; 441/29

[58] Field of Search ..... 114/21, 22, 23, 24, 114/25, 26, 28, 6, 29; 24/127, 130

[56] References Cited

U.S. PATENT DOCUMENTS

| | | | |
|---|---|---|---|
| 409,434 | 8/1889 | Taylor et al. | 24/130 |
| 1,636,447 | 7/1927 | Standish | 441/26 X |
| 1,993,974 | 3/1935 | McVicker | 441/25 |
| 2,104,762 | 1/1938 | Riner | 441/28 X |
| 3,742,535 | 7/1973 | Horrer et al. | 441/23 |

*Primary Examiner*—Sherman D. Basinger
*Attorney, Agent, or Firm*—James R. Cwayna

[57] ABSTRACT

A marker bouy to positively mark positions on a water surface with respect to the bottom. The marker includes a generally hollow body with line wound around the approximate center thereof with a weight on the end of the line which will cause the marker to rotate when the marker is placed or thrown onto the water surface to cause the line to unwind from the marker. A line stop flange is provided on the marker to stop unwinding of the line when the weight strikes the bottom. This flange comes into effect when water partially fills the marker which will cause the marker to shift from a position of lying on the water surface to being erect within the water. When the marker is in the upright or erect position, the line is engaged by the line stop flange. When the marker is in this erect or upright position, one end will be above the surface of the water and therefore easily visible.

6 Claims, 6 Drawing Figures

FLOATING MARKER

FIELD OF THE INVENTION

This invention relates generally to markers which are used to mark locations in water and more particularly to a marker for marking positions on water which includes a line controlling unit which will prevent the marker from moving from the designated position by preventing further line removal from the floating portion of the unit.

BACKGROUND AND PRIOR ART OF THE INVENTION

It is well known among fishermen and others using water and lake and river bottoms to use floating markers to mark locations, for example, to which they wish to return to fish. These markers normally consist of a dumbbell construction with a line wrapped between the two floatable ends of the dumbbell with a weight on the end of the line. When the marker is placed or thrown to the desired location, the weight will cause the line to unreel from the marker. When the weight hits the bottom the floating portion of the marker may be moved by currents, waves, wind or the like and therefore the floating marker will not mark the desired location. The user does not want to lift the marker and try to retrace the line as this will cause movement of the bottom weight and therefore the marker has served no purpose.

In his search of the prior art, the applicant has found the following, various patents: Wolfe, U.S. Pat. No. 4,103,379; Bayles, U.S. Pat. No. 3,471,877; Davis, U.S. Pat. No. 3,827,093; Ewing, U.S. Pat. No. 3,519,983; Parker, U.S. Pat. No. 4,074,380; Faulstich et al, U.S. Pat. No. 4,004,310 and Kealoha, U.S. Pat. No. 4,238,864.

All of these patents disclose various forms of marker bouys which may be thrown or placed upon the water for marking locations and which include a weighted line which will unreel from the floating portion of the marker. None of these references illustrate nor describe a marker bouy which will shift from a surface position to an erect or upright position and more importantly, none of these references illustrate a marker bouy which has means to prevent further unreeling of line from the marker, that is to say that the floating portion will remain directly above the point of bottom which is being marked.

SUMMARY AND OBJECTS OF THE INVENTION

The applicant's invention basically consists of two chambers with a necked down area therebetween with the line being wrapped about this necked down area when the same is not in use and a formable weight being attached to the free end of the line with the chambers and necked down area being hollow and interconnected with an outwardly extending line engaging flange which will prevent the unreeling of more line from the floating portion of the marker when the weight strikes the bottom.

The line engaging flange is located on one side of the necked down area and surround one of the chambers. This particular chamber is provided with ballast at the end thereof and an aperture is provided through this end to allow water to enter. The water entering and the ballast combination will cause the floating portion to shift to a vertical position. In this vertical position, the opposite chamber will be above the water surface and therefore will be more visible than if it were lying on the water surface.

The marker is also provided with outwardly directed fins. These fins slow down the rotation of the marker as the line is being unreeled therefrom and prevent water from entering the breather holes of the marker while the marker is rotating and line is being dispensed. The fins also prevent the marker from rotating in a counterclockwise direction when in the erect or upright position. Counterclockwise rotation may cause the line to become disengaged from the line stop flange and rather, these fins insure that the marker will rotate in a clockwise direction to insure line engagement when the marker is being affected by wave action.

An object, therefore, of the invention is to provide a floating marker which will limit the amount of line being removed from the marker and therefore the marker will remain in close proximity to the desired marked bottom portion.

It is another object of the applicant's invention to provide a floating marker which will shift from a water surface lying position to an erect or upright position in the water to have a portion thereof above the water surface for ease of locating the same.

It is still another object of the applicant's invention to provide a floating marker device designed and constructed for admission of water into one end thereof to insure that the same will shift from a "horizontal" to a "vertical" position.

It is still a further object of the applicant's invention to provide a marker bouy having a plurality of outwardly directed fins to limit the speed of rotation of the marker and therefore the speed of line removal therefrom when the same lies on the surface of the water.

It is still a further object of the applicant's invention to provide a marker bouy having a plurality of outwardly directed fins which will insure that the marker will only rotate in a clockwise direction such that the line that has been removed therefrom will remain in a trapped or held position on a line stop flange of the marker.

These and other objects of the invention will more fully appear from a consideration of the accompanying description made in conjunction with the accompanying drawings.

DESCRIPTION OF A PREFERRED FORM OF THE INVENTION

Figure 1:
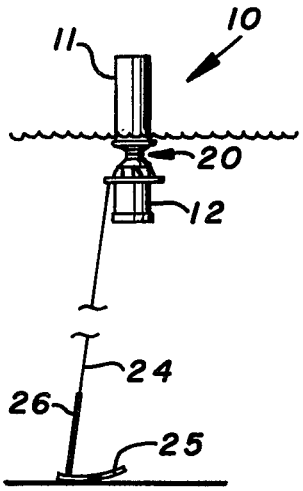
FIG. 1 is an illustration of the marker bouy embodying the concepts of the applicant's invention as the same would appear when it is in marking position.
Figure 2:
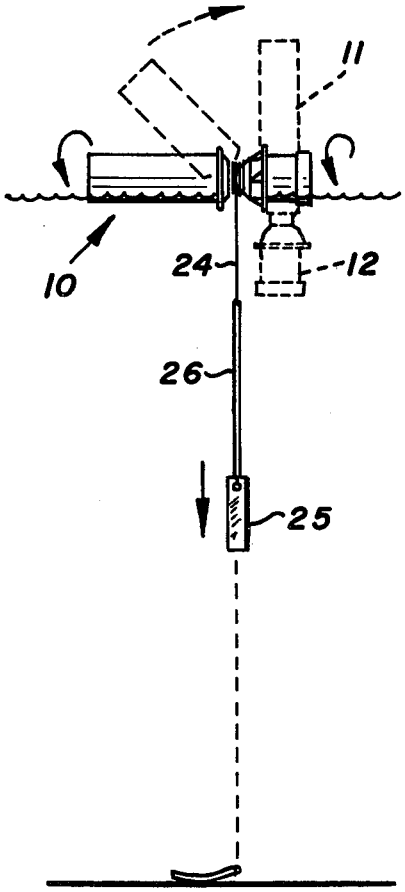
FIG. 2 is a schematic illustration of the marker which shows the various movements of the marker as the same is placed or thrown onto the surface of the water, the various arrows showing the downward movement of the weight, the resulting rotation of the bouy and final movement of the bouy to an erect or vertical position.
Figure 3:
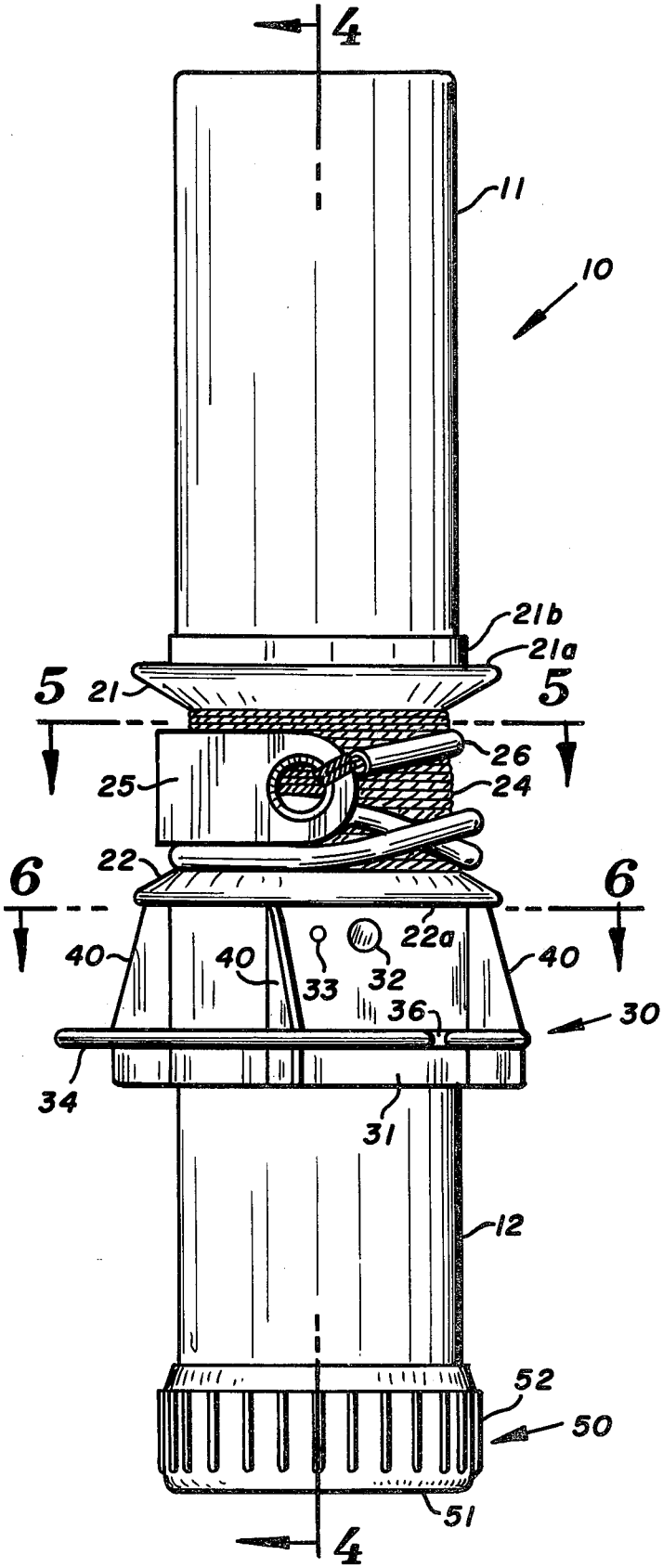
FIG. 3 is a vertical view of the exterior of the bouy.

In accordance with the accompanying drawings, the marker bouy embodying the concepts of the applicant's invention is generally designated 10.

The bouy basically is a longitudinally extending, hollow body member and, in the form shown, consists of two hollow, generally cylindrical units 11, 12 having necked down mating and connecting areas 13, 14 on one end thereof with the opposite end of unit 11 being closed as at 15 with the opposite end of unit 12 having an end 16 with a central aperture 16*a*. This aperture allows for the admission of water into unit 12 which will, as will be discussed hereinafter, assist in shifting the marker from a horizontal to a vertical position.

A line winding reel is arranged in the area provided by the necked down portions of the units 11, 12. This reel is generally designated 20 and, in the form shown, includes a pair of inwardly directed sides 21, 22, joined by a flat section 23. The combination of sides 21, 22 and the flat bottom portion 23 provide a line receiving area and an amount of line 24 is illustrated as it would be located in the wound-up position. The line 24 must obviously be attached to the reel 20 at one end thereof and the other end thereof is provided with a weight 25 which is comprised of a relatively soft lead material such that it may be formed about the wound up line 24. A shield 26 such as section of plastic tubing is provided adjacent the weighted end of the line 24 to provide protection of the line 24. As is obvious, the weight 25 may be dropped into a rocky area and the line 24 could be easily damaged.

As illustrated, the inwardly directed sides of the reel 20 are frictionally engaged to the inwardly directed surfaces of the necked down units 11, 12.

As further illustrated, the inwardly directed sides 21, 22 of reel 24 extend outwardly beyond the diameter of units 11, 12 to provide shoulders 21*a*, 22*a*. As illustrated, the shoulder 21*a* also is provided with a cylindrical sleeve portion 21*b* which engages the exterior of unit 11. Shoulder 22*a* also has an inner surface 22*b* which engages the exterior of unit 12 and this shoulder 22*a* also proves a plurality of undercut areas 22*c* for the receipt of elements which will be described hereinafter to prevent rotation of the reel.

A line stop flange 30 having an interal sleeve 31 for positioning about the exterior of unit 12 is also provided. Proper positioning of this flange is provided by a pin 32 passing through sleeve 31 and the wall of unit 12. Also, as illustrated, a plurality of breather holes 33 are provided through sleeve 31 and the wall of unit 12.

The means for stopping and trapping the line consists of an outwardly extending, relatively thin disc member 34 having a plurality of particularly shaped fingers and slots arranged thereon. In the form shown, four such units, each designated 35 are provided. Each unit includes a straight, line pickup section 35*a*, which may be termed a forward section, due to the normal and controlled, clockwise rotation of the marker, and a smoothly curved rear section 35*b*. The curved rear section 35*b* terminates directly forwardly of the pickup section 35*a* and a line capturing slotted area is provided within the disc. This slotted area is designated 36 and provides a maze or hook shaped area into which the line 24 will be received and held. Due to the hook shape of the slot 36, a limited counterclockwise motion could be permitted without disengagement but, this is eliminated as will be discussed.

Figure 4:
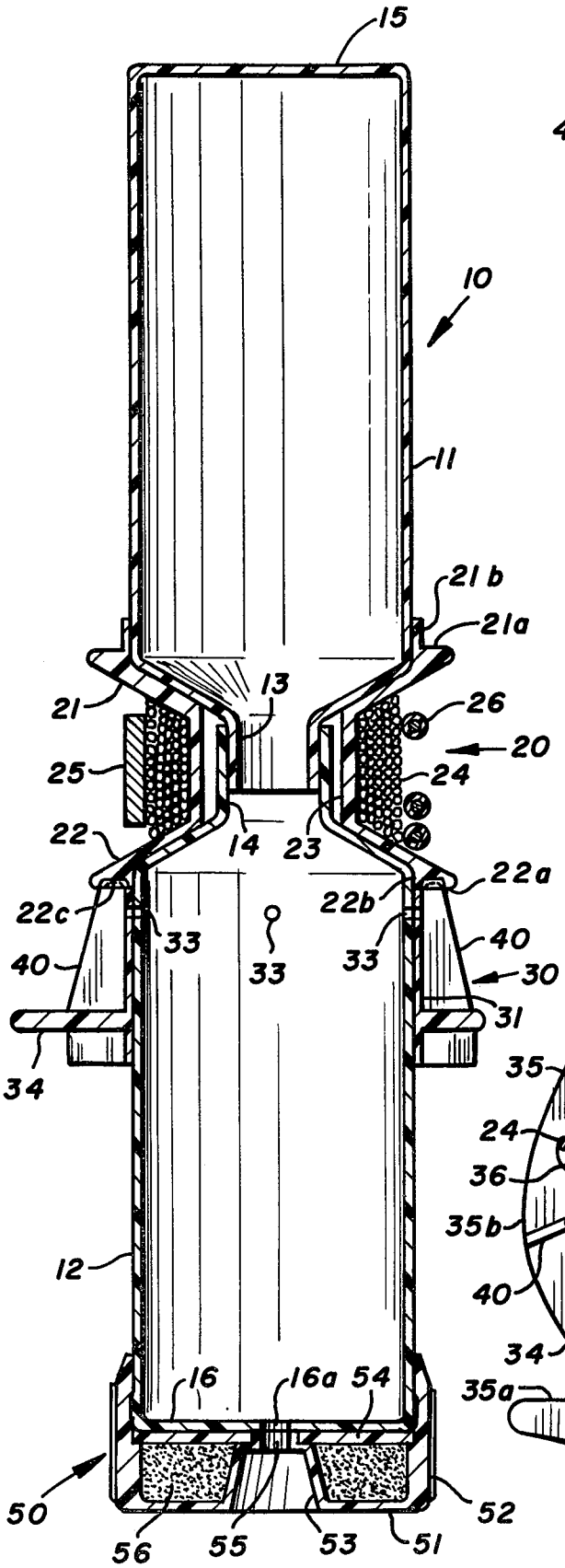
FIG. 4 is a vertical section taken substantially along Line 4—4 of FIG. 3.
Figure 5:
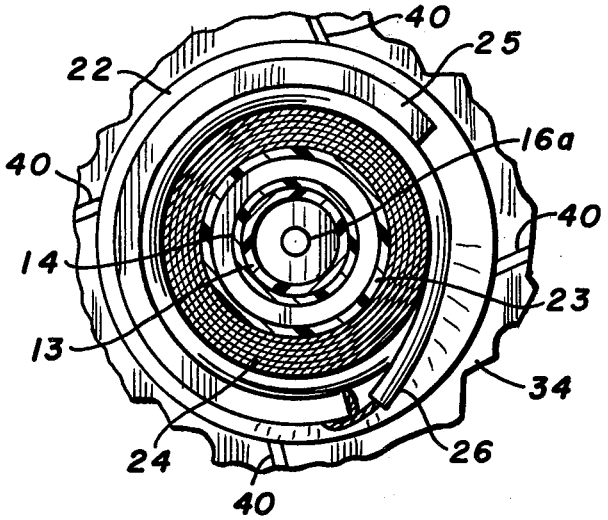
FIG. 5 is a horizontal section taken substantially along Line 5—5 of FIG. 3; and, FIG. 6 is a horizontal section taken substantially along Line 6—6 of FIG. 3.

Also arranged on the sleeve 31 are a plurality of direction vanes 40. These vanes extend longitudinally of the sleeve 31 and taper inwardly, as best illustrated in FIG. 4, and the upper ends thereof are received into the undercut areas 22*c* of the reel 20. These upper ends then interfere with the non-cut areas of the shoulder 22*a* and prevent rotation of the reel on the unit 11.

Figure 6:
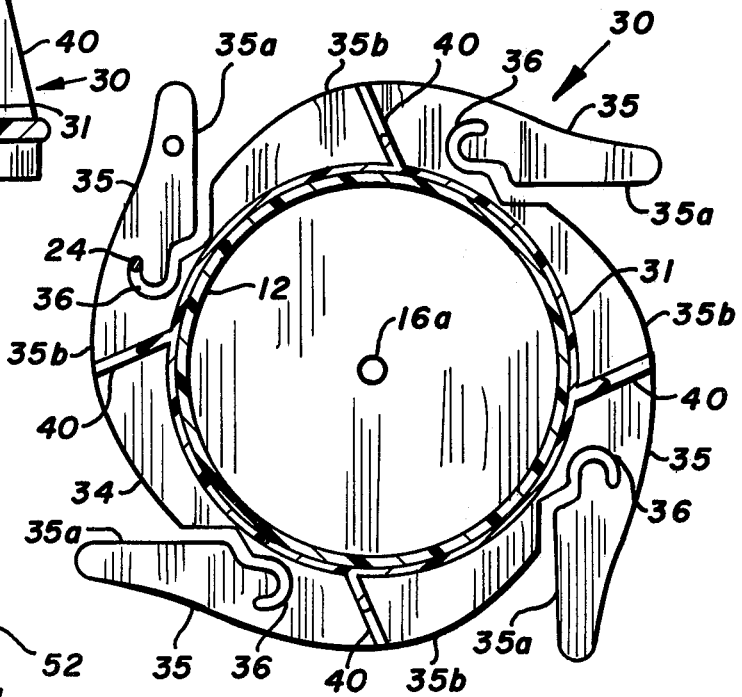

As also illustrated, particularly in FIG. 6, these vanes are arranged angularly with respect to the axis of the unit 11 and each vane 40 is arranged adjacent a breather hole 33. The angularity is selected to permit water to flow smoothly thereof when the market 11 is rotated in a clockwise direction and may be further defined as overlying the breather holes.

These vanes then provide a plurality of functions. They prevent water from entering the breather holes as the marker is rotating on the surface of the water, they prevent counterclockwise rotation of the marker when the same is in the erect position, they prevent rotation of the reel portion of the marker relative to the marker and they slow the rotation of the marker when line is being drawn therefrom by the dropping weight.

To assist in righting of the marker 11, a ballast cup is provided on the apertured end of unit 12. This cup is designated 50 and basically provides a bottom, upstanding cylindrical sides 52 to engage the outer surface of unit 12, an inner tapered surface 53, a top 54 and an aperture 55 to mate with the aperture 16*a* into the unit 12 for the admission of water into the same. As illustrated, the bottom, sides, inner tapered surface and top provide a toroidal shaped area into which ballast is placed.

The operation of the unit should be obvious from a consideration of the objects of the invention and a description of the elements of the unit.

When the user of the marker desires to mark an underwater location such as a reef or bar or shallow or deep water or for any other reason, he simply opens the weight 25 from its normal line storage position and either places the same or throws the same on the water surface. When the marker strikes the surface it will lie upon the surface in what may be termed a horizontal position. At this time, the weight will begin to descend into the water and will unreel line from the reel. The vanes will slow the rotation of the marker such that an override and undesired release of line will not occur. When the weight strikes the bottom, water will begin to enter the ballasted end of the marker and air will be forced from the breather holes. As the filling continues the marker will be tilted to the erect or upright position. As this tilting occurs, the line will be engaged with the line stop flange and will become lodged in the line trapping slot areas. When this trapping occurs, no further line will be unreeled and a positive location, in close proximity, to being directly above the desired location will be provided. The upstanding end of the marker will be above the water surface and therefore will be easily oserved. This end will always remain above the water surface due to the entrapped air in the unit. The vanes on the marker insure that the marker will always rotate in a clockwise direction thus maintaining the line entrapment but it should be obvious that the line unreeling could be changed and the entrapping slots could be changed and the vanes could be changed without departing from the scope of the invention.

It should be obvious that this invention provides advantages worthy of patentable merit over the prior art.

What I claim is:

1. A marker bouy for marking underwater locations, said bouy including:

a. a hollow, generally cylindrical body member;

b. a length of line having one end thereof attached to said body member and being normally wrapped about said body member;

c. a weight attached to the other end of said line, said weight causing said body member to rotate upon the surface of the water when dropping downwardly from the surface;

d. a water admitting aperture on one end of said body member to admit water interiorally thereof to increase the weight of such end to shift said body from a first position of lying on the water surface to a second position of being vertical in the water;

e. a radially extending flange arranged on the end of said body having said aperture;

f. a line trapping member defined within said flange; and, g. at least one vane member extending radially outwardly from said body and arranged longitudinally thereof adjacent said flange to normally slow the rotation of the marker.

2. The structure set forth in claim 1 and said line trapping member including a slot, said slot being directed towards the direction in which the body member will rotate when in a vertical direction.

3. The structure set forth in claim 2 and a plurality of said slots being formed within said flange.

4. The structure set forth in claim 3 and a line pickup member being closely associated with each of said slots to guide the line therein.

5. The structure set forth in claim 1 and a plurality of said vane members extending radially outwardly from said body to said flange and extending longitudinally of said body.

6. The structure set forth in claim 5 and said vane members being angularly offset to the longitudinal axis of said body to permit rotation of the body in one direction and normally preventing rotation of said body in the opposite direction.

* * * * *